US007631592B2

(12) United States Patent
Kossmann

(10) Patent No.: US 7,631,592 B2
(45) Date of Patent: Dec. 15, 2009

(54) POSITION MEASURING SYSTEM FOR A HYDRAULIC CYLINDER

(75) Inventor: Gerhad Kossmann, Weisweil (DE)

(73) Assignee: Liebherr-France SAS, Colmar Cedex (FR)

( * ) Notice: Subject to any disclaimer, the term of this patent is extended or adjusted under 35 U.S.C. 154(b) by 369 days.

(21) Appl. No.: 11/715,198

(22) Filed: Mar. 7, 2007

(65) Prior Publication Data

US 2007/0214952 A1 Sep. 20, 2007

(30) Foreign Application Priority Data

Mar. 8, 2006 (DE) ..... 10 2006 010 780

(51) Int. Cl.
*F01B 31/12* (2006.01)

(52) U.S. Cl. ..... 92/5 R

(58) Field of Classification Search ..... 91/1; 92/5 R; 324/207.21

See application file for complete search history.

(56) References Cited

U.S. PATENT DOCUMENTS 5,012,239 A * 4/1991 Griebeler ..... 341/15
5,450,009 A * 9/1995 Murakami ..... 324/207.21
6,393,963 B1 * 5/2002 Kadlicko ..... 92/5 R
7,116,097 B2 * 10/2006 Revankar et al. ..... 324/207.13
7,367,257 B2 * 5/2008 Kadlicko ..... 92/5 R

FOREIGN PATENT DOCUMENTS

EP 0618373 10/1994

* cited by examiner

*Primary Examiner*—Michael Leslie
(74) *Attorney, Agent, or Firm*—Dilworth & Barrese, LLP.

(57) ABSTRACT

This invention relates to a position measuring system for a hydraulic cylinder, which comprises at least one sensor, one magnet and a piston rod with a metallic core of high magnetic susceptibility and with a groove structure in substantially axial direction, wherein the groove structure is filled up with a metal which has a lower magnetic susceptibility than the core, so that the sensor measures a magnetic field of the core which is changed by the groove structure and thus can determine both the relative and the absolute position of the piston rod.

46 Claims, 7 Drawing Sheets

POSITION MEASURING SYSTEM FOR A HYDRAULIC CYLINDER

BACKGROUND OF THE INVENTION

The present invention relates to a position measuring system for a hydraulic cylinder, in which at least one sensor for detecting magnetic fields recognizes a pattern provided on a piston rod of the hydraulic cylinder and thus determines the position of the piston.

Position measuring systems for hydraulic cylinders are used wherever the control or regulation of the length of stroke requires a precise knowledge of the position of the piston.

From EP 0 618 373 B1 a position measuring system is known, in which the piston rod is provided with a groove structure and this structure is scanned magnetically. There are used very deep structures, which are filled up with a ceramic coating. Such ceramic coatings are very hard, but have the disadvantage that the sharp-edged ceramic grains abrasively damage the sealing system of the hydraulic cylinder. Thus, a system with a ceramic coating is not suitable for applications with many cylinder strokes and is limited in its useful life.

SUMMARY OF THE INVENTION

Therefore, it is the object of the present invention to provide a position measuring system for hydraulic cylinders, in which improved surface properties of the piston rod provide for a reduced wear and thus a longer useful life of the system.

In accordance with the invention, this object is solved by a position measuring system for hydraulic cylinders as described herein. Here, the core of the piston rod is made of a metal with a high magnetic susceptibility and has a groove structure substantially in axial direction. This groove structure is filled up with a metal which has a lower magnetic susceptibility than the core. A magnet fixed in its axial position generates a magnetic field which is changed by the groove structure, this change being measured by at least one sensor. Since the change of the magnetic field depends on the position of the groove structure, the position of the piston can be determined by measuring said change.

Due to the use of a metal for filling up the groove structure, it is possible that the piston rod has excellent surface properties with respect to hardness, wear, corrosion resistance and useful life, which properties correspond to those of a piston rod without position measuring system. In particular, the surface therefore is very smooth, so that other components of the cylinder, such as the sealing system, are not damaged and the entire system thus has a long useful life. Furthermore, the use of metal for filling up the groove structure provides for a small depth of this groove structure, so that the notch effect thereof becomes negligeable and the construction of the cylinder need not be changed. Furthermore, the entire sensor system as well as the electronic system evaluating the same is provided in this system in a pressureless region, where it cannot be damaged by pressure peaks. On the whole, this provides a simply constructed and extremely robust system, which can be manufactured and operated at low cost and in particular as a result of the low wear can also be used for a system with many cylinder strokes. Furthermore, the measuring system of the invention can be incorporated in any cylinder, without having to fundamentally change the construction thereof.

Preferably, the at least one sensor measures the magnetic field along a specified direction, which increases the sensibility of the sensor for changes of the magnetic field. Preferably, the magnet is a permanent magnet, whose north-south axis extends in dependence on the arrangement and orientation of the sensor (30, 40). In particular, the north-south axis can extend radially with respect to the piston, whereas the specified direction, in which the at least one sensor measures the magnetic field, extends vertical thereto in axial direction. Thereby, it is ensured that a shift of the groove structure in axial direction greatly influences the magnetic field measured by the sensor, which increases the accuracy and reliability of the position measurement.

Preferably, the groove structure consists of grooves and elevations, wherein axially adjacent grooves or elevations of the groove structure preferably each have the same distance from each other, and furthermore the groove structure preferably has a periodic and in particular substantially sinusoidal shape in axial direction. By means of such a periodically changing structure, the position determination is facilitated, as with a movement of the piston rod the magnetic field measured by the at least one sensor likewise changes periodically with the movement.

The change of the measured magnetic field by such a period thus corresponds to a shift of the position of the piston rod in axial direction by the distance between two adjacent grooves or elevations. By counting the periods in the measured magnetic field, the relative movement of the piston position thus can easily be calculated.

To also provide for an absolute position determination, individual grooves or elevations preferably can be omitted, in order to form reference marks. The reference marks preferably are arranged such that the number of elevations or grooves, which are located between two adjacent reference marks, each differs over the entire groove structure, so that each interval between two reference marks is characterized unambiguously by the number of elevations or grooves. At the latest after the sensor has detected a second reference mark, it thus can also exactly indicate the absolute position of the piston rod.

The inventive position measuring system for a hydraulic cylinder, in particular with the inventive reference marks for the absolute position determination of the piston rod, furthermore has the advantage that the reference marks already can be recognized unambiguously due to the use of two sensors, and thus a simple and inexpensive construction is possible with only few sensors. In addition, the system thereby can be realized in a small and space-saving form and need not be mounted in a fixed radial position with respect to the piston rod, which again provides for a simple and inexpensive construction.

Preferably, the reference marks are arranged such that the distances between two reference marks are smallest in those areas of the piston rods for which a fast indication of position is important. Usually, this is the beginning and the end of the piston rod, and great distances between the reference marks can be arranged in the middle of the piston rod, where a fast indication of position is less important.

Preferably, the metallic core of high magnetic susceptibility is ferromagnetic, and the metal of lower magnetic susceptibility, which fills up the groove structure, is not ferromagnetic. Preferably, the metallic core is made of steel.

Preferably, the metal filling up the groove structure substantially consists of chromium. Of course, other metals or alloys can be used here as well, but what is decisive merely is the difference in the magnetic susceptibility. In particular, non-ferromagnetic nickel can also be used. The difference between the magnetic susceptibility of the metallic core with the groove structure provided thereon and the magnetic susceptibility of the metal filling up the groove structure effects that the strength of the magnetic field generated by the magnet greatly fluctuates in dependence on the position of the groove structure, in particular in axial direction. This fluctuation of the magnetic field now can be measured by the sensor, which preferably is located between the magnet and the piston rod, namely in direct vicinity of the piston rod. Therefore, the use of ferromagnetic material for the core is advantageous, as the same greatly intensifies the magnetic field acting from outside, whereas non-ferromagnetic material does not have this property. As compared to ferromagnetic material, non-ferromagnetic material can change the magnetic field only to a very small extent, such change being possible both in positive and in negative direction depending on the material. In most alloys, steel is ferromagnetic, so that the piston rod made of steel, which is commonly used in hydraulic cylinders, can be used for the system of the present invention without major changes. Chromium, on the other hand, is not ferromagnetic, so that it is excellently suited as a metal filling up the groove structure, in particular as it also satisfies the remaining requirements for the surface of the piston rod with respect to hardness, roughness, corrosion resistance and useful life.

Alternatively, the groove structure preferably can also be filled up with a non-ferromagnetic nickel alloy, such non-ferromagnetic nickel alloy preferably comprising an amount of phosphorus of more than 10.5%. This can provide advantages in particular with respect to corrosion protection.

Furthermore, such non-ferromagnetic nickel layer filling up the groove structure can be ground smooth and be coated again with chromium.

Furthermore, it is preferably possible to provide a further metal layer between the metallic core of high susceptibility and the metal of low susceptibility filling up the groove structure. The magnetic properties of this metal layer are not decisive, so that by means of this additional metal layer properties such as corrosion resistance, useful life and adhesion of the metal filling up the groove structure can be improved decisively. In particular, a thin ferromagnetic nickel layer is useful for this purpose, which preferably is electrodeposited or deposited electroless onto the groove pattern and furthermore preferably has a thickness of less than 50 μm. This metal layer, in particular of nickel, primarily serves the improved corrosion protection of the rod. The layer possibly is magnetic, but does not change the signal measured by the sensor, as it uniformly grows over the entire groove structure.

Preferably, the groove structure alternately has grooves and elevations, the depth of the grooves with respect to the elevations preferably being about 200 μm. The metal filling up the groove structure preferably completely fills up this groove structure, so that the thickness of the metal above the grooves is more than 200 μm. Above the elevations, the metal filling up the groove structure preferably has a thickness of about 50 μm. The possibly applied additional metal layer between the metallic core and the metal filling up the groove structure preferably has a thickness of less than 50 μm. This metal layer preferably is electrodeposited or deposited electroless onto the metallic core.

The metal filling up the groove structure, i.e. in particular chromium, preferably likewise is applied by electrodeposition onto the metallic core or onto the metal layer, in particular of nickel, surrounding the metallic core. Since the application of chromium layers with a thickness of more than 50 μm is problematic, because in such thick layers tensile stresses are produced, which lead to cracks, the metal filling up the groove structure, i.e. in particular chromium, preferably is applied by a multilayer method. In such multilayer method, the metal is applied in a plurality of layers of less than 50 μm each, a transition region being each formed between the layers, which reduces possible stresses. In such a structure of a plurality of thin layers one on top of the other, the frequency of cracks is very much smaller and cracks are stopped at the transition regions.

By regrinding the piston rod, superfluous metal filling up the groove structure is removed and the surface of the piston rod is smoothed. Preferably, the minimum thickness of the metal filling up the groove structure, i.e. in particular of the chromium, should not fall below 50 μm. By regrinding the piston rod a smooth surface is obtained, which in particular has no disadvantage as compared to a normal piston rod with respect to hardness, roughness, corrosion resistance and useful life.

When the groove structure is filled up with a non-ferromagnetic nickel alloy, this is preferably likewise effected by electrodeposition. Non-ferromagnetic nickel layers can, however, also be deposited electroless. Upon regrinding the piston rod for smoothing the surface, the same now preferably is coated with a chromium layer, which preferably likewise is effected by electrodeposition and again improves the surface properties.

A sensor for measuring the magnetic field preferably comprises a magnetoresistive sensor, which furthermore preferably is composed of a plurality of magnetoresistive resistor structures. There are used either conventional magnetoresistive sensors or GMR (Giant-Magneto-Resistant) sensors. Both types of sensor are excellently suited for measuring magnetic fields, the GMR sensors having a better efficiency. Preferably, these magnetoresistive resistor structures are arranged in two bridge circuits, the sine and cosine circuits, the distance of the magnetoresistive resistor structures preferably being adapted to the period length of the groove structure. The sensor is located between magnet and piston rod and measures the magnetic field preferably in axial direction, as this component is influenced most during an axial movement of the piston rod and hence of the groove pattern.

The signals output by such sensor preferably are evaluated via their quadrature signal, which can furthermore be evaluated via a quadrature counter and provides an incremental position signal with a resolution of one quarter of the period length of the groove structure. The quadrature counter counts the slopes of the sine and cosine signals, an analysis of the phase relation between the two signals preferably providing a statement as to the direction. If a higher resolution of the position is required, the resolution preferably can be increased by forming a coefficient from the sine and cosine signals to such an extent that resolutions better than $1/360$ of the period length of the groove structure can be achieved.

Preferably, the position measuring system of the invention includes two sensors which have a fixed distance from each other in axial direction. In particular, the distance between the two sensors advantageously is a multiple and here in particular a twofold of the period length of the groove structure. The reference marks in the form of omitted grooves or elevations can be recognized by a comparison of the signals from the two sensors, which also provides for an absolute position measurement.

If there was used only one sensor chip with sine and cosine bridges, passing a reference mark could not be detected unambiguously. The sensor would only detect that the magnetic field no longer changes for a certain period. However, this could also be due to the fact that the piston rod is no longer moved and the system thus is at rest. This problem preferably is solved by using the second sensor. If the sensor passes an omitted groove or elevation, the reading of the first quadrature counter first remains constant, whereas the second counter, which corresponds to the second sensor, goes on. If the second sensor now passes the same omitted groove or elevation, the reading of the corresponding second quadrature counter stops. Having completely passed the reference mark, the two counters then again operate synchronously. By means of such signal, a reference mark can be detected unambiguously.

If the number of elevations or grooves, which are located between two adjacent reference marks, preferably is different for each interval between two reference marks, the absolute position can be determined unambiguously when passing a second reference mark by counting the interposed grooves or elevations and by determining the direction of movement from the phase relation between the sine and cosine signals. In particular, this is possible by using only two sensors, which saves costs and allows a space-saving configuration.

Furthermore, the position measuring system for a hydraulic cylinder in accordance with the present invention preferably includes a sensor holder, which includes a sliding member, in which the sensors and the magnet are disposed, and a spring. The sliding member preferably made of aluminum together with the sensors ensures that the sensors can be guided along the piston rod surface at a distance as small and constant as possible. The sliding member is movably mounted in a housing, and it is urged against the surface of the piston rod by a spring. Preferably, the front side of the sliding member, which faces the piston rod, is curved, the inner radius of the sliding member preferably being smaller than the radius of the piston rod, so that the sliding member rests on the piston rod only on its outer edges and thus slides along said piston rod. The distance between the plane of the sensors and the surface of the piston rod preferably is less than 1 mm. At this distance, the magnetic field measured by the sensors still is greatly influenced by the groove structure, which provides for a safe and precise recognition of the groove structure. Here, it should be noted on the whole that for increasing the signal strength the distance of the sensors from the groove structure should not be very much greater than the depth of the groove structure, i.e. at least lie within the same order of magnitude.

To reduce friction and to improve the protection against wear, the sliding member made of aluminum preferably is coated. Furthermore, this coating preferably consists of an electrodeposited intermediate layer with PTFE inclusions.

Furthermore, the present invention comprises a method for producing a piston rod of an inventive position measuring system for a hydraulic cylinder, wherein the groove pattern of the invention is ground into the metallic core, one or more layers of a metal of lower magnetic susceptibility than the core are electrodeposited or deposited electroless onto the groove structure, with chromium or a non-ferromagnetic nickel alloy being used in particular, and wherein the metal filling up the groove structure is ground to obtain a smooth surface.

Preferably, before applying the metal filling up the groove structure, one more metal layer, in particular a nickel layer, is electrodeposited or deposited electroless in accordance with this method.

Preferably, after grinding the metal filling up the groove structure, in particular when using a non-ferromagnetic nickel alloy for filling up the groove structure, the method of the invention furthermore comprises a step in which a further metal layer, in particular chromium, is electrodeposited or deposited electroless.

The pattern applied onto the piston rod of the present invention continuously was referred to as groove structure. Advantageously, the groove pattern surrounds the entire periphery of the piston rod in a rotationally symmetric way, as due to this fact the orientation of the piston rod need not be observed when assembling piston rod and sensor. It is also possible to rotate the piston rod, in particular also with a simultaneous axial movement, without influencing the measurement result of the position measuring system of the present invention. Quite obviously, however, such extension of the groove pattern in a radial direction is not decisive for the functioning of the position measuring system of the invention. For the functioning of the measuring system, the groove structure must merely have one extension in radial direction, which corresponds to the extension of the sensor used. If this extension is very small, the individual grooves and elevations can also largely be dot-shaped. As for the present invention, however, chiefly the axial structure is of importance, such arrangement also is referred to as groove structure.

It is likewise quite obvious that the reference marks described above for the absolute determination of the position of the piston can also be used completely independent of the concrete design of the rule and the measuring apparatus, as the underlying idea can be used for every rule with substantially periodic marks. In such a general, absolute position measuring system, the reference marks then are formed by omitted or changed marks on the rule.

A sensor which detects the marks during a movement of the rule and thus measures a relative movement of the rule, can recognize the changed or omitted mark and hence the reference mark either directly or by comparison with a second sensor, which has a certain distance from the first sensor in the direction of movement of the rule.

For the unambiguous identification of the individual reference marks, the reference marks preferably are arranged such that the number of marks disposed between two adjacent reference marks each differs over the entire groove structure, so that each interval between two reference marks is unambiguously characterized by the number of marks. At the latest after the sensor has detected a second reference mark, it can also exactly indicate the absolute position of the rule.

The above-mentioned advantages of the special system likewise are obtained for the general reference marks for the absolute determination of the position of a rule, just as the properties described in the special system, in particular with respect to the number and the distance of the marks, the reference marks and the sensors, can be transferred to the general system.

It is likewise quite obvious that the construction of the sensor holder, in particular with the sliding member with an inner curvature with a smaller radius than the radius of the piston rod and the surface coating, can be used independent of the concrete design of the marks on the piston rod.

The same is true for the construction of the sensors, which likewise is independent of the concrete design of the marks on the piston rod.

BRIEF DESCRIPTION OF THE DRAWINGS

In the following, the present invention will be described in detail with reference to embodiments illustrated in the drawings, in which.

DESCRIPTION OF THE PREFERRED EMBODIMENTS

Figure 1:
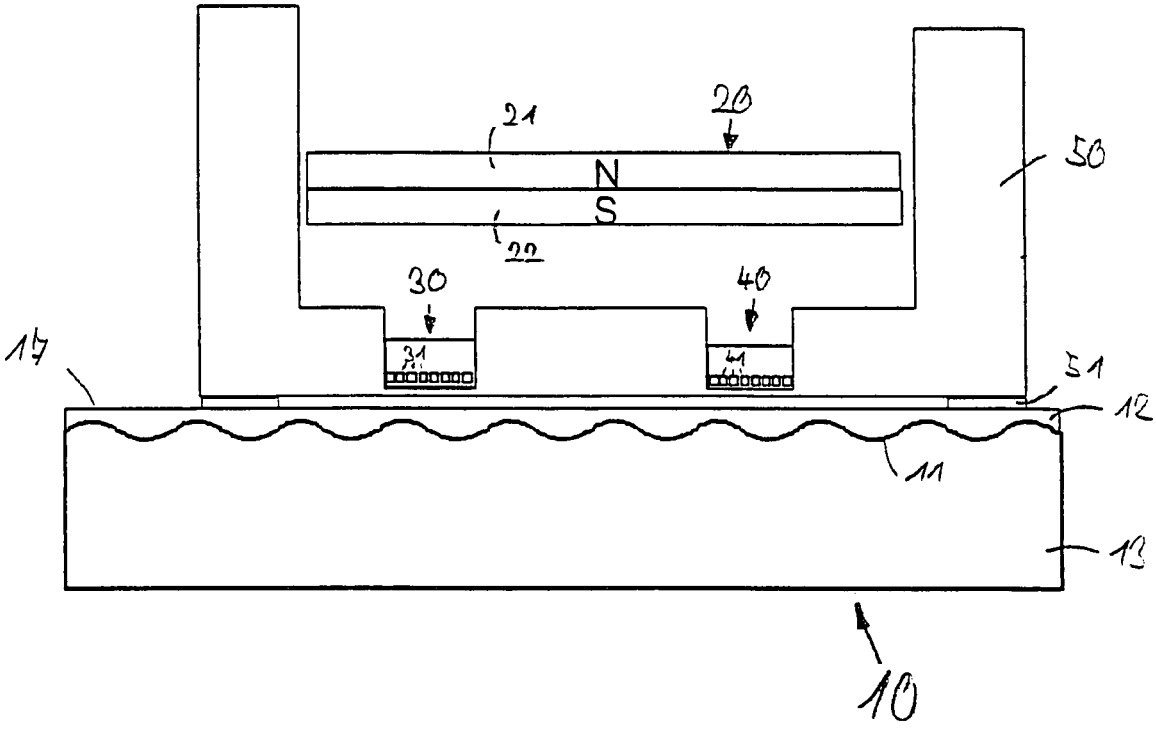
FIG. 1: shows a schematic sectional view of an embodiment of the position measuring system for a hydraulic cylinder of the present invention.

The embodiment of a position measuring system for a hydraulic cylinder, which is shown in FIG. 1, comprises a piston rod 10 with a metallic core 13 of high magnetic susceptibility, a groove structure 11 in substantially axial direction, and a metal 12 with a lower magnetic susceptibility than the core 13, which fills up the groove pattern 11 and has a smooth surface 17. Furthermore, the embodiment of the inventive position measuring system comprises a permanent magnet 20, in which the north pole 21 and the south pole 22 are arranged such that the north-south axis of the permanent magnet 20 substantially extends in radial direction and thus vertical to the axis of the piston rod 10. Between the permanent magnet 20 and the piston rod 10, magnet sensors 30 and 40 are disposed, which here constitute magnetoresistive sensor chips, which are composed of magnetoresistive resistor structures 31, 41. The magnetoresistive resistor structures 31, 41 are disposed in one line parallel to the axis of the piston rod 10 close to the surface 17 of the piston rod 10. The two sensors 30 and 40 have a fixed axial distance, which in the illustrated embodiment corresponds to three times the period length of the groove structure 11. The magnet 20 and the sensors 30, 40 are mounted in a sliding member 50, which rests on the surface 17 of the piston rod 10 via a coating 51.

Figure 2:
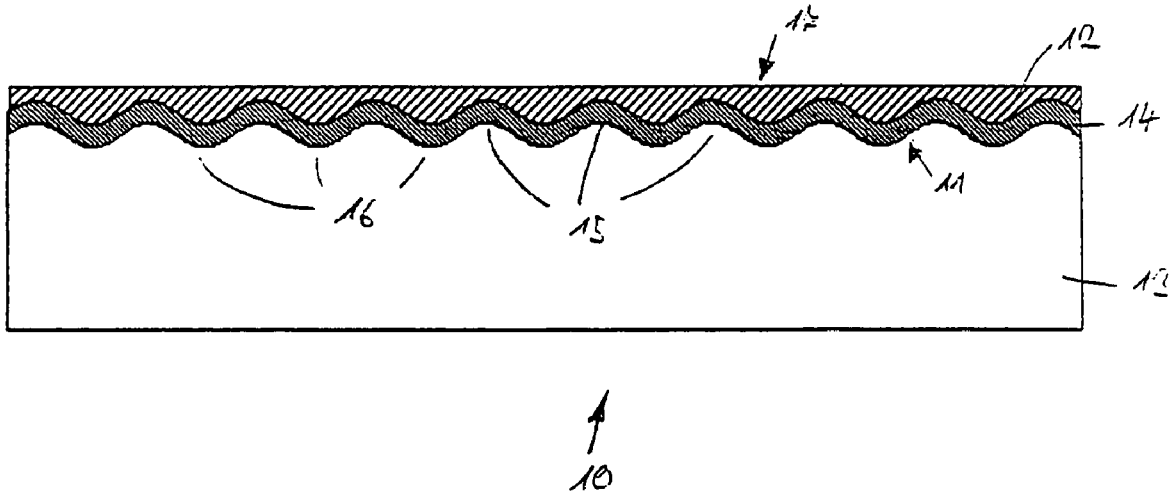
FIG. 2: shows a schematic sectional view of a first embodiment of a piston rod in accordance with the present invention.

FIG. 2 shows a first embodiment of a piston rod 10 of the present invention. The groove structure 11 extends in axial direction substantially sinusoidal over the length of the piston 10. In the first embodiment, the wavelength of the groove structure 11 is 2 mm and the depth of the groove structure 11 is about 200 μm. The groove structure 11 is ground into the ferromagnetic core 13 of the piston rod 10 substantially radially symmetrically about the entire periphery of the piston rod 10. The depth of the groove structure 11 corresponds to the difference in the thickness of the core 13 between grooves 16 and elevations 15. As is common practice in hydraulic cylinders, the core 13 of the piston rod 10 is made of steel, and the construction of the cylinder need not be changed especially for the position measuring system, as due to the small depth of the groove structure, the notch effect thereof is negligeably small. In the first embodiment, a thin intermediate metal layer 14 made of ferromagnetic nickel is applied onto the groove structure 11. This thin ferromagnetic nickel layer 14 is electrodeposited or deposited electroless onto the core 13 with a thickness of less than 50 μm. This intermediate layer serves the improved corrosion protection of the rod. It possibly is magnetic, but does not change the signal form measured by the sensors, as it uniformly grows over the entire structure. Thereupon, the groove structure 11 is filled up with a non-ferromagnetic metal, in this case with chromium. The chromium layer 12 filling up the groove structure 11 is electrodeposited, and due to the thickness of the chromium layer of more than 200 μm, a multilayer chromium layer is used. Applying thick chromium layers of more than 50 μm is problematic, as in thick layers tensile stresses are produced, which lead to cracks.

These cracks can reach down to the base material and thus are points of attack for the corrosion of the piston rod. In the multilayer method, the chromium is applied in layers of less than 50 μm. Between the layers, a transition region is each formed, which reduces tension. The frequency of cracks thus is much lower, and cracks are stopped at the transition regions. As a result of electrodeposition, the multilayer chromium layer uniformly grows on the nickel layer 14, so that the surface of the piston rod 10 still has a groove pattern 11 upon application of the multilayer chromium layer. Said groove pattern is removed by regrinding the piston rod 10, and upon grinding, the chromium layer 12 still has a minimum thickness of 50 μm above the elevations 16. By regrinding the piston rod, a smooth surface 17 is obtained, whose surface properties (hardness, wear, corrosion resistance, useful life) correspond to those of a normal system without position measurement. In particular, the surface 17 also has a very low roughness, so that the remaining components of the hydraulic cylinder, in particular the sealing system, cannot be damaged by abrasion and the system is also suitable for applications with many piston strokes. Due to the use of ferromagnetic steel for the core 13 and non-ferromagnetic chromium for the metal 12 filling up the groove structure 11, a great magnetic contrast is obtained on this groove structure 11, which greatly changes the magnetic field generated by the magnet 20.

Figure 3A:
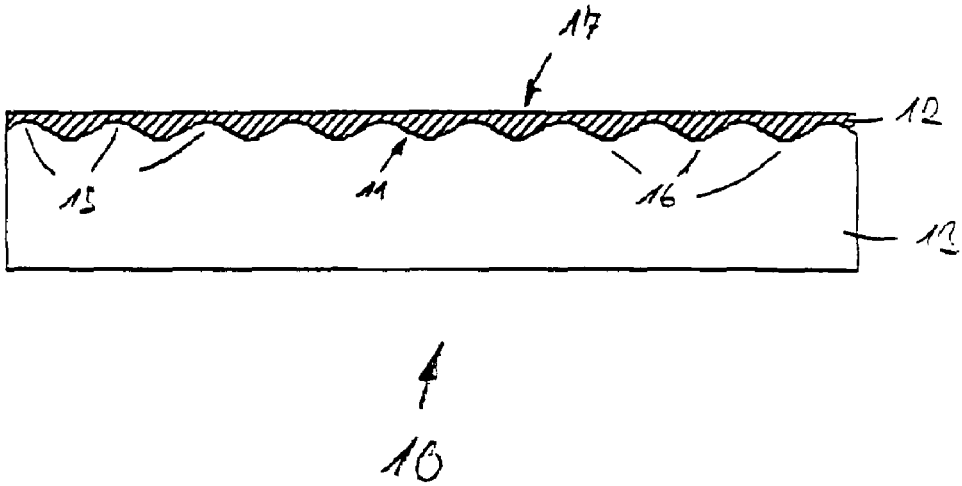
FIG. 3*a*: shows a schematic sectional view of a second embodiment of a piston rod in accordance with the present invention.

FIG. 3*a* shows a second embodiment of a piston rod of the present invention, which substantially corresponds to the first embodiment of the piston rod, but where the nickel layer 14 is omitted. In the first embodiment, this nickel layer 14 is used as an additional corrosion protection for extreme conditions of use and can also be omitted, as shown in the second embodiment, whereby the construction becomes simpler and production costs can be saved.

Figure 3B:
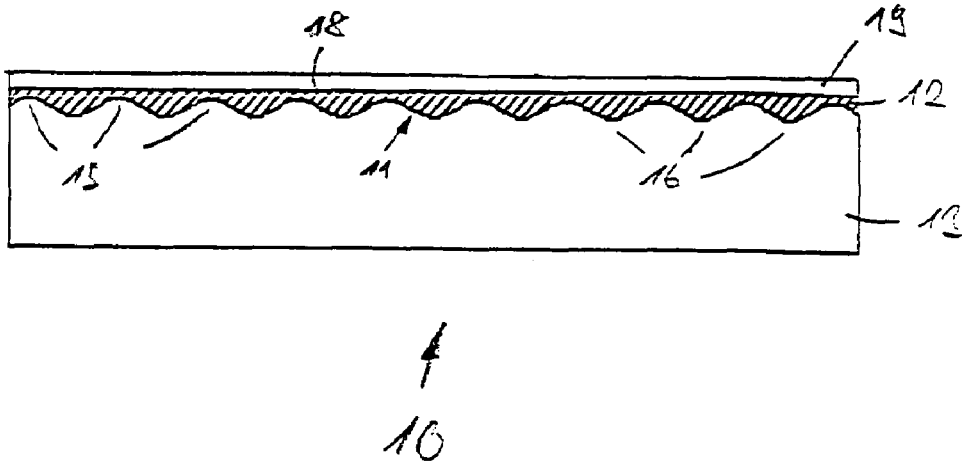
FIG. 3*b*: shows a schematic sectional view of a third embodiment of a piston rod in accordance with the present invention.

FIG. 3*b* shows a third embodiment of a piston rod of the present invention, wherein the groove structure 11 is filled up with an electrodeposited non-ferromagnetic nickel layer 12. It should be noted that electrodeposited nickel layers generally have ferromagnetic properties and thus are not suitable for filling up the groove structure. Since more than 10.5% of phosphorus are incorporated in the layer, non-ferromagnetic nickel can, however, also be electrodeposited. These non-ferromagnetic nickel layers would be easier to deposit electroless, but for such electroless filling up of the groove structure 11 the structure depth is too great. Since the nickel layer 12 is grown uniformly, the surface thereof still has a groove structure 11 upon growing. Said groove structure is removed by regrinding the piston rod, so that a smooth surface 18 is obtained. Finally, the piston rod 10 is conventionally coated with a chromium layer 19. This construction also provides excellent properties with respect to hardness, wear, corrosion resistance, useful life and smoothness of the surface. Moreover, the individual layers can be applied easily and at low cost. Again, a great magnetic contrast is obtained on the groove structure 11 by using a ferromagnetic core 13 and a non-ferromagnetic metal 12 for filling up this groove structure 11, whereby the magnetic field generated by the magnet 20 is greatly deflected.

Figure 4:
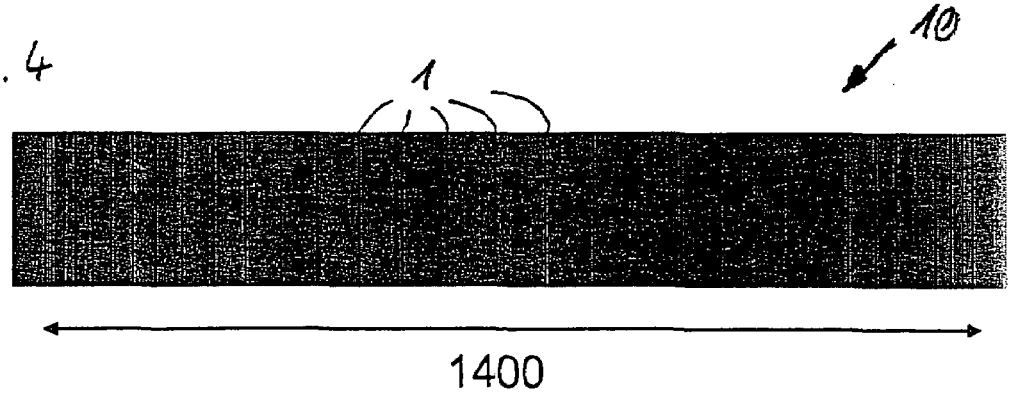
FIG. 4: shows a schematic view of a fourth embodiment of a piston rod in accordance with the present invention with reference marks provided thereon.

The sensors 30, 40 measure this deflection of the magnetic field, when the piston rod 10 is moved past the same in axial direction. The magnetic field changes periodically with the groove structure 11, so that relative positions can be measured by counting the periods. However, for an absolute position measurement, additional information is required, which in the fourth embodiment shown in FIG. 4 is provided to a piston rod 10 of the present invention in the form of reference marks 1. These reference marks 1 are set by omitting grooves 16 and elevations 15 in the otherwise periodic groove structure 11. In the fourth embodiment of the piston rod 10 of the invention, the reference marks 1 are arranged such that the number of elevations 15 or grooves 16, which are located between two adjacent reference marks 1, each differs across the entire groove structure 11, so that each interval between two reference marks is unambiguously characterized by the number of elevations or grooves between the two reference marks. Having passed two successive reference marks 1, the absolute position thus is known. By arranging the reference marks 1 on the embodiment of the piston rod, the maximum travel up to a reference point, i.e. up to an indicated absolute position, can be specified. If a particularly fast reference, e.g. at the terminal positions of the cylinder, is desired, the reference marks are arranged such that the distance between two reference marks is at a minimum at the terminal positions, as shown in FIG. 4.

In this fourth embodiment of the piston rod 10 of the present invention, the omitted grooves are arranged such that, starting from the left side, five grooves are located between the first two omitted grooves. The distance between the second and third omitted grooves is seven grooves, between the third and fourth nine grooves, and so on. Starting from the right side, the distance between the first and second omitted grooves is six grooves. The distance between the second and third omitted grooves is eight grooves, then ten, twelve and so on. The transition from even to odd distances then is effected in the middle of the rod. In this embodiment, the total number of grooves is approximately 1400.

By means of the reference marks 1 in the form of omitted grooves or elevations and the unambiguously identifiable distances between two such reference marks 1, a reliable and precise absolute position measurement can be realized in a fast and easy way, without having to use a complex pattern.

Figure 5A:
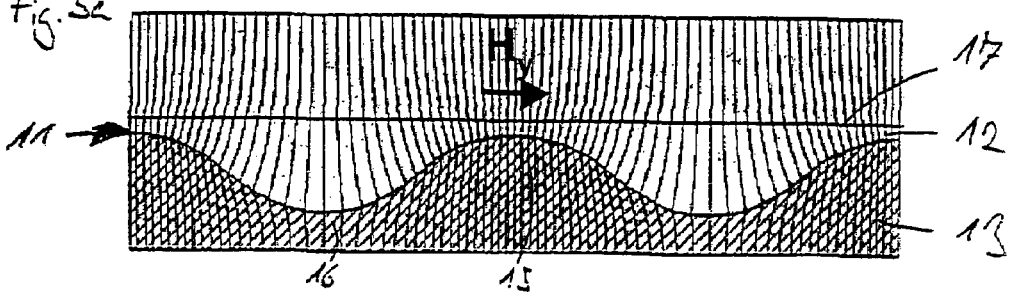
FIG. 5*a*: shows a schematic sectional view of a magnetic field H changed by the groove structure.

FIG. 5*a* shows how the magnetic field of the non-illustrated magnet 20 located above the image segment is changed due to the groove structure 11. The lines extending from the top to the bottom constitute the lines of force of the magnetic field, wherein small distances between the lines represent a strong magnetic field and greater distances between the lines represent a weaker magnetic field. At a large distance from the surface 17 of the piston rod 10, the magnetic field largely is undisturbed and uniformly extends in radial direction, i.e. from the top to the bottom in this Figure. The non-ferromagnetic metal 12 used for filling up the groove structure 11 has a very low susceptibility and therefore hardly intensifies the magnetic field in its interior. Thus, it virtually does not influence the course of the field lines, which in the Figure can also be recognized by the fact that the field lines are not broken at the surface 17. Things are quite different, however, with the ferromagnetic metal of the core 13. The same has a very high susceptibility and intensifies the magnetic field in its interior, which can also be recognized by the fact that the magnetic field lines are broken at the groove structure 11. In the case of the elevations 15 located closer to the magnet 20, the magnetic field therefore is stronger than in the grooves 16 further away from the magnet 20. This can be recognized in FIG. 5*a* by the very much smaller distances of the magnetic field lines on the elevations 15 as compared to the grooves 16. In the region above the groove structure 11, the magnetic field therefore no longer extends radially, but has a component $H_y$ in axial direction, which generally is different from 0.

Figure 5B:
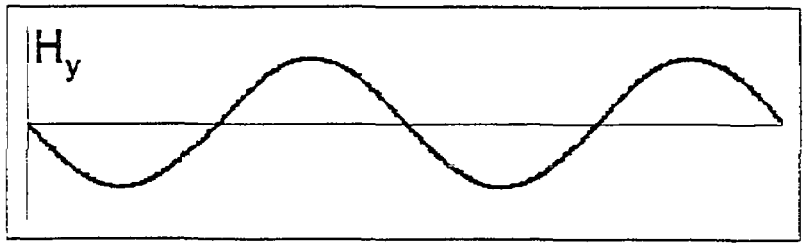
FIG. 5*b*: shows the change of a magnetic field $H_y$ in axial direction in dependence on the axial position above the groove structure.

In FIG. 5*b*, the strength of the magnetic field $H_y$, measured slightly above the surface 17 of the piston rod 10, is indicated in dependence on the position above the groove structure 11. As in this embodiment the groove structure 11 substantially has the shape of a sinusoidal curve, the component $H_y$ of the magnetic field in axial direction also has such a shape. Directly above an elevation 15 or a groove 16, the magnetic field $H_y$ in axial direction is 0, above the inclined portions between the grooves 16 and the elevations 15, however, each either positive or negative. In this embodiment, the sensors are arranged in a plane parallel to the axis of the piston rod 10 at a distance of less than 1 mm from the surface 17 of the piston rod 10. The permanent magnet 20 and the sensors 30, 40 of this embodiment are firmly mounted in axial direction, whereby the magnetic field $H_y$ measured by the sensors is modulated sinusoidally during an axial movement of the piston rod 10. The modulation of the magnetic field $H_y$ by one period corresponds to the movement of the piston rod by the distance between two grooves.

The sensors 30, 40 used in this embodiment constitute magnetoresistive magnetic-field sensors. These standard sensors for measuring modulated magnetic fields consist of a plurality of magnetoresistive resistor structures 31, 41, which are connected in two bridge circuits, the sine and cosine bridges. The selection of the sensors 30, 40 is effected such that the geometric distances of the resistors on the sensor chip are adapted to the period length of the magnetic field structure to be measured, and hence to the period length of the groove structure 11. GMR sensors could, however, also be used just as well.

Figure 6A:
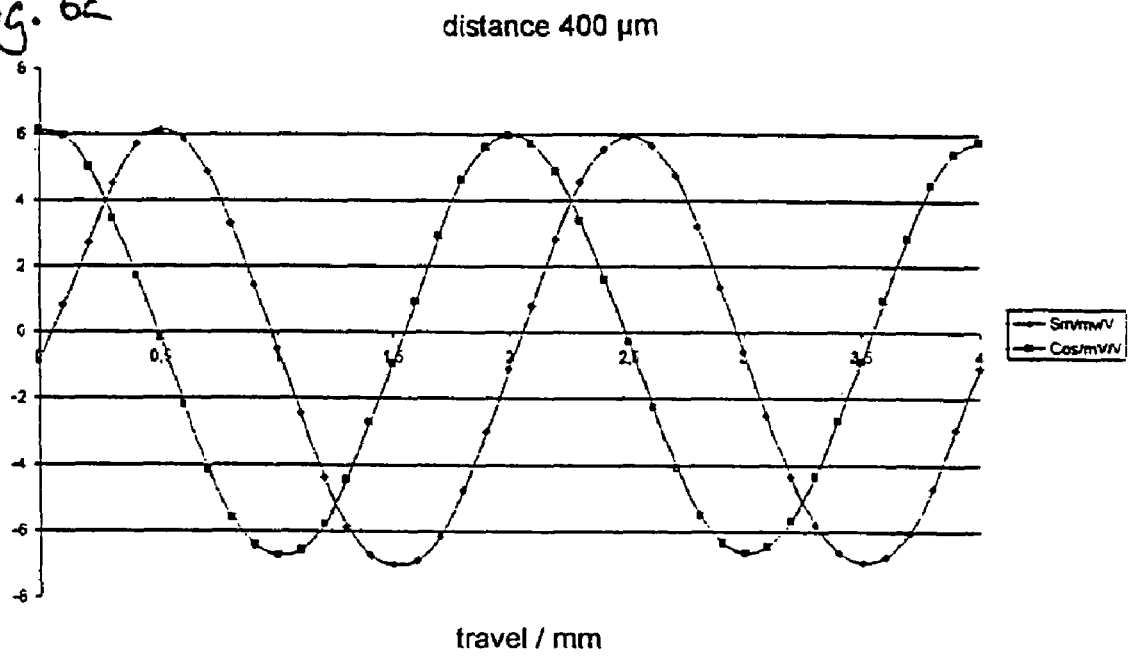
FIG. 6*a*: shows output signals of a sine and cosine circuit of one embodiment of a sensor of the present invention.

FIG. 6*a* shows the signal of the sine and cosine bridges, whereas the inventive piston rod 10 with the groove structure 11 is moved past a sensor in axial direction, wherein the sensor is offset from the center of the magnet by 2.6 mm transverse to the direction of measurement, and the magnetoresistive resistor structures 31, 41 of the sensors 30, 40 are located at a distance of 400 μm from the surface 17 of the piston rod 10. FIG. 6*a* clearly shows the sinusoidal curves of the measurement signals shifted against each other.

Figure 6B:
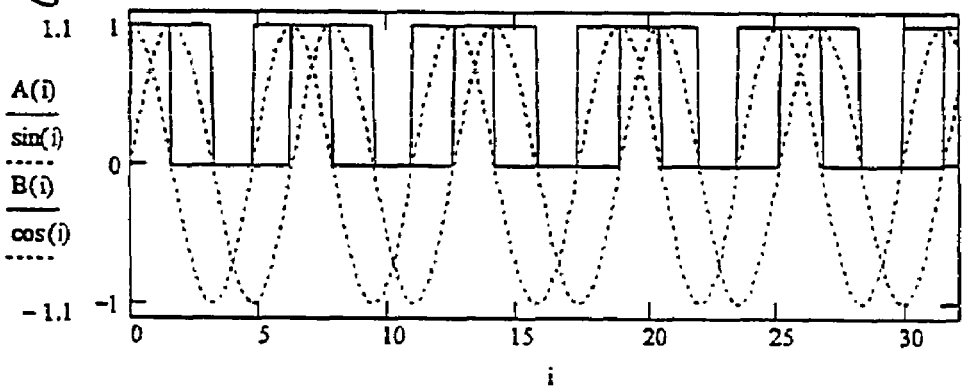
FIG. 6*b*: shows the evaluation of these sine and cosine signals via their quadrature signal.

These two signals can be evaluated with standard methods and then provide the positions. The evaluation can be effected via the quadrature signal, as shown in FIG. 6*b*. By means of a comparator circuit with hysteresis, the signals are converted to an A-B quadrature signal. This signal can then be evaluated with a quadrature counter and provides an incremental position signal with a resolution of one quarter of the period length of the groove structure 11. The quadrature counter counts the slopes of the sine and cosine signals, wherein an analysis of the phase relation between the two signals provides a statement as to the direction of the movement. If a higher resolution of the position is required, the resolution can be increased by forming a quotient from the sine and cosine signals. In this way, resolutions better than 1/360 of the period length of the groove structure 11 can be achieved. Thus, the use of a sensor 30, 40 already provides for an extremely accurate determination of the relative movement of the piston rod.

For an absolute position measurement, however, the additional information from the reference marks 1 is required. When using only one sensor 30, 40, passing a reference mark cannot be detected unambiguously. The sensor only "sees" that the magnetic field no longer changes for a certain period. This could, however, also be due to the fact that the piston rod 10 is not moved.

This problem is solved by using two sensors 30, 40. The sensors 30, 40 have a fixed distance from each other in axial direction. In the embodiment of the invention, this fixed distance is 4 mm, which corresponds to the distance between two grooves. Arranging the two sensors with a distance which corresponds to a multiple of the period length of the groove structure 11 has the advantage that the two sensors provide the same signal, if there is no reference mark under any of the two sensors. By comparing the signals generated by the two sensors, a reference mark 1 thus can be detected unambiguously. For this purpose, the distance between the two sensors should, however, be smaller than the minimum distance between two reference marks 1. When a reference mark now is moved past the sensors, the reading of the quadrature counter of the first sensor 30 first remains constant, whereas the quadrature counter of the second sensor 40 goes on. Thereupon, the reference mark 1 also moves past the second sensor 40, so that the reading of the quadrature counter of the second sensor 40 is not changed, whereas the reading of the quadrature counter of the first sensor 30 goes on. After the reference mark 1 has passed the two sensors 30, 40, the two quadrature counters again operate synchronously. A reference mark 1 thus can clearly be recognized by such signal behavior.

If a second reference mark 1 now is also moved past the sensors 30, 40, the present specific reference mark 1 can be identified unambiguously by counting the grooves 16 or elevations 15 between the two reference marks and by determining the direction of movement from the phase comparison between the sine and cosine signals. Thus, the absolute position of the piston rod 10 also is known unambiguously. In particular, this is possible with only two sensors, so that space and costs can be saved in the construction.

Figure 7:
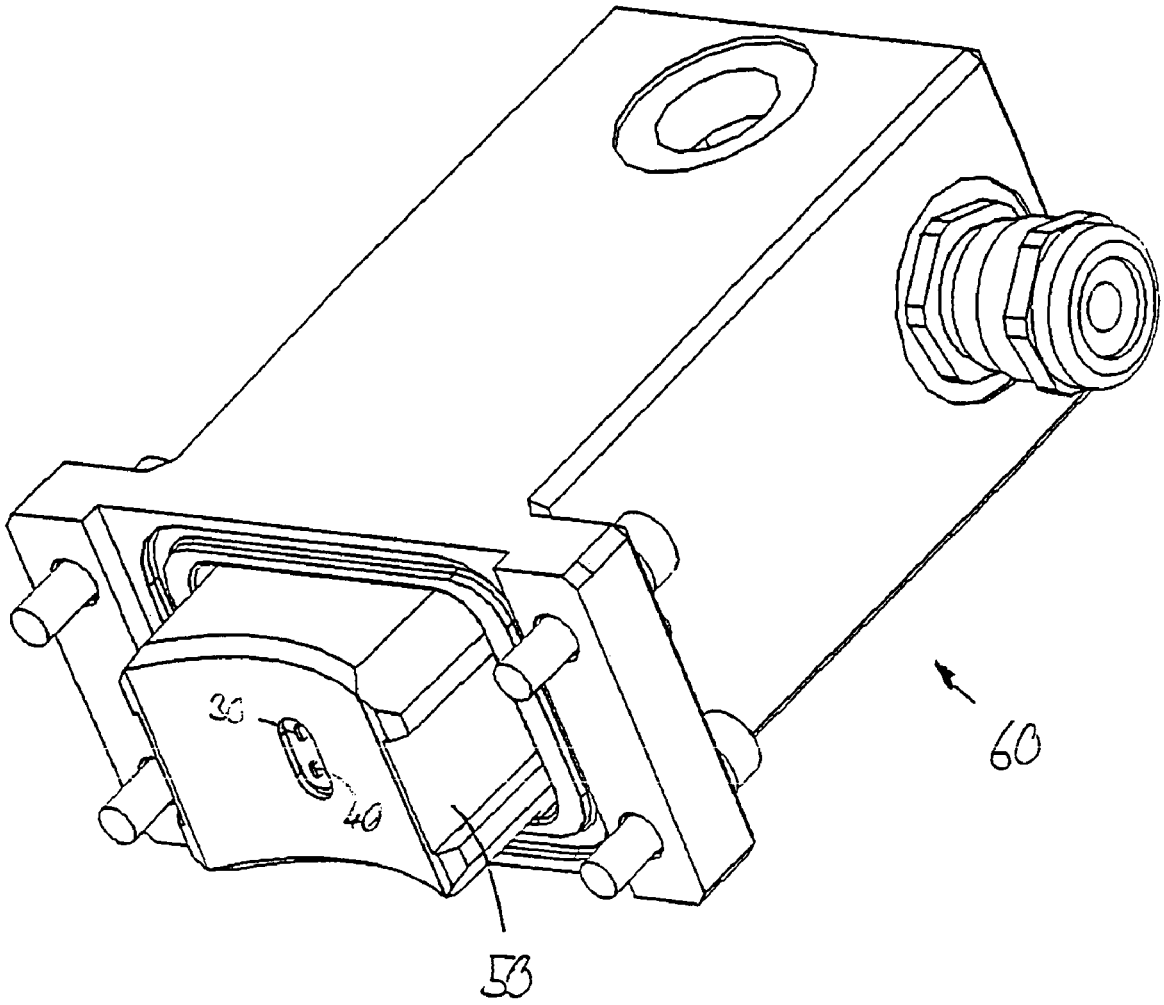
FIG. 7: shows a perspective view of one embodiment of a sensor holder of the present invention.
Figure 8:
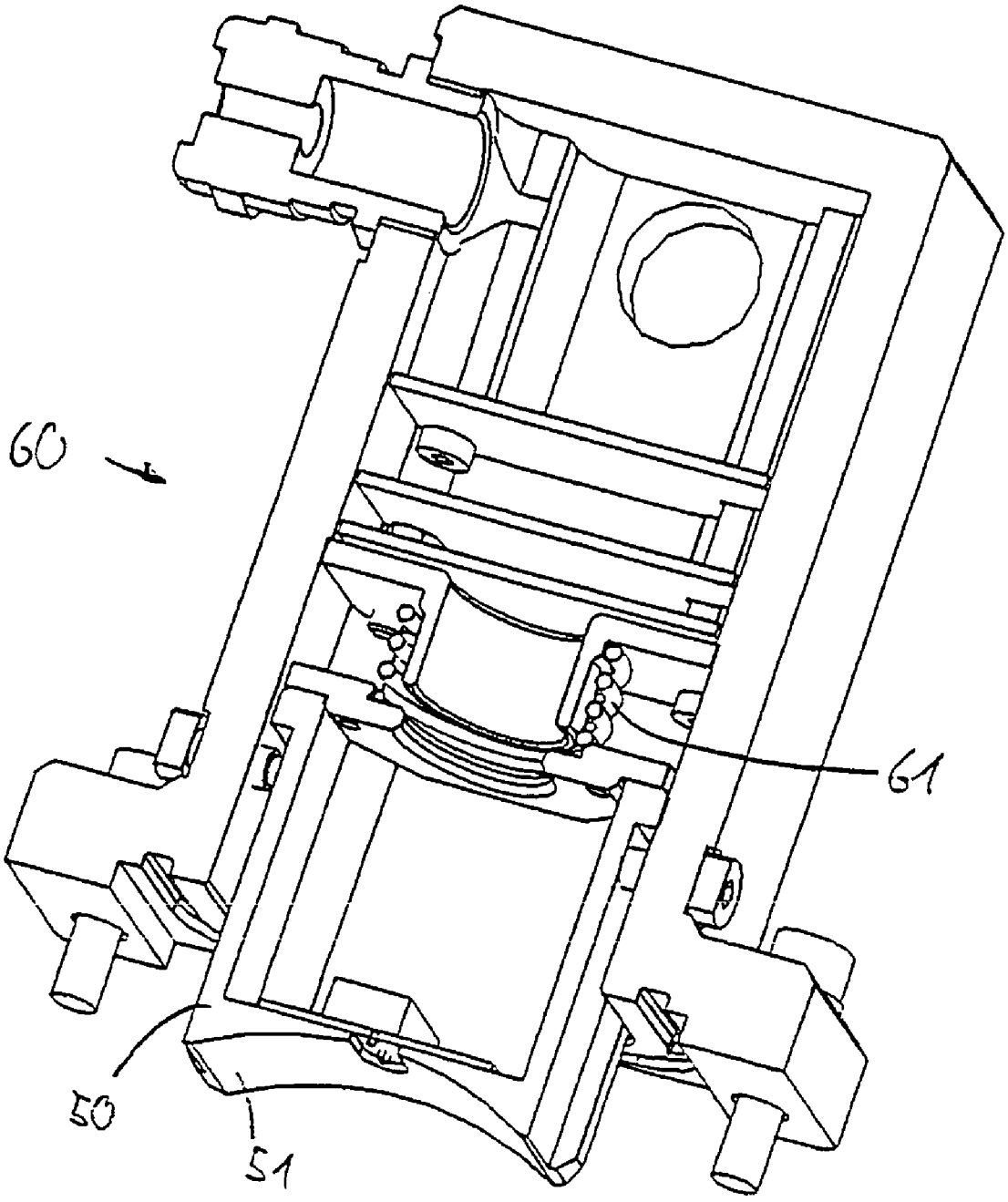
FIG. 8: shows a perspective view of a cutaway embodiment of the sensor holder of the present invention.

FIGS. 7 and 8 show the construction of an embodiment of a sensor holder 60 of the present invention. The sensor holder 60 is designed such that the two magnetoresistive sensors 30, 40 can be guided along the surface 17 of the piston rod 10 at a rather small and constant distance. The small distance between the piston surface 17 and the sensors 30, 40 is important, because only at a small distance from the groove structure 11 the magnetic field of the magnet 20 located behind the sensors is greatly changed by the groove structure 11. To obtain a good signal, the magnetic field should be measured as close as possible to the surface 17 and hence as close as possible to the groove structure 11. This distance should also remain constant during an axial movement of the piston rod 10, so that the measurement results are not distorted.

The embodiment of the sensor holder 60 of the invention therefore comprises a sliding member 50 of aluminum, which holds the sensors 30 and 40 and the permanent magnet 20. The sliding member 50 is urged onto the piston rod 10 by a spring 61. The distance between the plane of the magnetoresistive resistors 31, 41 in the sensors 30, 40 and the surface 17 of the piston rod 10 is less than 1 mm.

The inside of the sliding member 50 is curved such that its inner radius is smaller than the radius of the piston rod, so that the sliding member slides along the piston rod only on its outer edges.

To reduce friction and to improve the protection against wear, the sliding member 50 of aluminum is provided with a coating 51 in this embodiment. The coating is an electrodeposited nickel layer with PTFE inclusions.

The entire sensor holder 60 is integrated in the cylinder lid in the pressureless region. To avoid wear as a result of dirt penetrating from outside, a scraper and seals or guiding strips are disposed between the system and the outer region.

This provides for an additional increase in the stability and useful life of the construction, as the entire sensor system and electronic system is located in a pressureless region and thus cannot be damaged by pressure peaks.

This is advantageous in particular as compared to magnetorestrictive measurement systems, as in these systems the measurement system must be integrated in the high-pressure region of the cylinder.

The invention claimed is:

1. A position measuring system for a hydraulic cylinder, comprising a magnet (20), at least one sensor (30, 40), and a piston rod (10) with a metallic core (13) of high magnetic susceptibility and a groove structure (11) in a substantially axial direction, wherein the groove structure (11) is filled up with a metal (12) which has a lower magnetic susceptibility than the core (13), so that the at least one sensor (30, 40) measures a magnetic field of the magnet (20) which is changed in dependence on the position of the groove structure (11), wherein the metal (12) comprises a plurality of individual layers of said metal, and having a transition region between adjacent individual layers.

2. The position measuring system for a hydraulic cylinder as claimed in claim 1, wherein the at least one sensor (30, 40) measures the magnetic field along a specified direction.

3. The position measuring system for a hydraulic cylinder as claimed in claim 1, wherein the magnet (20) is a permanent magnet, whose north-south axis extends in dependence on the arrangement and orientation of the sensor (30, 40).

4. The position measuring system for a hydraulic cylinder as claimed in claim 1, wherein the groove structure (11) is composed of grooves (16) and elevations (15).

5. The position measuring system for a hydraulic cylinder as claimed in claim 4, wherein grooves (16) or elevations (15) adjacent in axial direction each have the same distance from each other.

6. The position measuring system for a hydraulic cylinder as claimed in claim 4, wherein the depth of the grooves (16) with respect to the elevations (15) is about 200 μm.

7. The position measuring system for a hydraulic cylinder as claimed in claim 4, wherein the metal (12) filling up the groove structure (11) has a thickness of more than 200 μm above the grooves (16).

8. The position measuring system for a hydraulic cylinder as claimed in claim 4, wherein the metal (12) filling up the groove structure (11) has a thickness of about 50 μm above the elevations (15).

9. The position measuring system for a hydraulic cylinder as claimed in claim 1, wherein the groove structure has a substantially sinusoidal shape in the axial direction.

10. The position measuring system for a hydraulic cylinder as claimed in claim 1, wherein the metallic core (13) is ferromagnetic and the metal (12) filling up the groove structure (11) is not ferromagnetic.

11. The position measuring system for a hydraulic cylinder as claimed in claim 1, wherein the metallic core (13) is made of steel.

12. The position measuring system for a hydraulic cylinder as claimed in claim 1, wherein the metal (12) filling up the groove structure (11) comprises chromium.

13. The position measuring system for a hydraulic cylinder as claimed in claim 1, wherein an intermediate metal layer (14) is provided between the metallic core (13) and the metal (12) filling up the groove structure.

14. The position measuring system for a hydraulic cylinder as claimed in claim 13, wherein the intermediate metal layer (14) comprises nickel.

15. The position measuring system for a hydraulic cylinder as claimed in claim 13, wherein the intermediate metal layer (14) has a thickness of less than 50 μm.

16. The position measuring system for a hydraulic cylinder as claimed in claim 13, wherein the intermediate metal layer (14) is electrodeposited or deposited electroless onto the metallic core (13).

17. The position measuring system for a hydraulic cylinder as claimed in claim 1, wherein the metal (12) filling up the groove structure has a smooth surface (17, 18).

18. The position measuring system for a hydraulic cylinder as claimed in claim 1, wherein an outer metal layer (19) is provided on the metal (12) filling up the groove structure.

19. The position measuring system for a hydraulic cylinder as claimed in claim 18, wherein the outer metal layer (19) comprises chromium.

20. The position measuring system for a hydraulic cylinder as claimed in claim 18, wherein the outer metal layer (19) has a thickness of about 50 μm.

21. The position measuring system for a hydraulic cylinder as claimed in claim 18, wherein the outer metal layer (19) is electrodeposited or deposited electroless.

22. The position measuring system for a hydraulic cylinder as claimed in claim 1, wherein the metal (12) filling up the groove structure (11) is electrodeposited or deposited electroless and ground to obtain a smooth surface (17, 18).

23. The position measuring system for a hydraulic cylinder as claimed in claim 1, wherein the at least one sensor (30, 40) is a magnetoresistive sensor or a GMR (Giant-Magneto-Resistant) sensor.

24. The position measuring system for a hydraulic cylinder as claimed in claim 23, wherein the sensor is composed of a plurality of magnetoresistive or GMR resistor structures (31, 41).

25. The position measuring system for a hydraulic cylinder as claimed in claim 24, wherein the magnetoresistive or GMR resistor structures (31, 41) are arranged in two bridge circuits, the sine and cosine circuits.

26. The position measuring system for a hydraulic cylinder as claimed in claim 25, further including a comparator circuit with hysteresis for converting signals output by the sensor (30, 40) to an A-B quadrature signal which is evaluated by a quadrature counter to provide an incremental position signal.

27. The position measuring system for a hydraulic cylinder as claimed in claim 25, further comprising a quadrature counter for counting the slopes of sine and cosine signals provided by the sina and cosine circuits, and further comprising means operatively associated with the quadrature counter for analyzing the phase relation of the signals from the sine and cosine circuits to provide a statement as to the direction of movement of the piston.

28. The position measuring system for a hydraulic cylinder as claimed in claim 25, further comprising means for forming a quotient of the signals from the sine and cosine circuits to increase the accuracy of a position analysis.

29. The position measuring system for a hydraulic cylinder as claimed in claim 24, wherein the distance of the magnetoresistive or GMR resistor structures (31, 41) is adapted to a period length of the groove structure (11).

30. The position measuring system for a hydraulic cylinder as claimed in claim 1, comprising two sensors which have a fixed distance in axial direction.

31. The position measuring system for a hydraulic cylinder as claimed in claim 30, wherein the distance includes a two-fold of the period length of the groove structure (11).

32. The position measuring system for a hydraulic cylinder as claimed in claim 31, wherein the piston rod includes reference marks (1) which are detectable by a comparison of the signals provided by the two sensors (30, 40).

33. The position measuring system for a hydraulic cylinder as claimed in claim 1, which furthermore includes a sensor holder (60) which has a sliding member (50), in which the sensors (30, 40) are located, and a spring (61) for biasing the sliding member onto the piston rod.

34. The position measuring system for a hydraulic cylinder as claimed in claim 33, wherein the sliding member (50) is made of aluminum.

35. The position measuring system for a hydraulic cylinder as claimed in claim 34, wherein the sliding member (50) has a coating (51) for reducing friction and for protection against wear.

36. The position measuring system for a hydraulic cylinder as claimed in claim 33, wherein the sliding member (50) has an inner radius which is smaller than the radius of the piston rod (10).

37. A method for producing a piston rod of the position measuring system for a hydraulic cylinder as claimed in claim 1, comprising the steps of: grinding the groove pattern (11) into the metallic core (13), electrodepositing or depositing electroless a plurality of layers of the metal (12) filling up the groove structure (11), and grinding the metal (12) filling up the groove structure (11) to obtain a smooth surface (17, 18).

38. The method for producing a piston rod as claimed in claim 37, wherein the hydraulic cylinder possesses an intermediate layer of a ferromagnetic metal (14), and before applying the metal (12) filling up the groove structure (11), the intermediate ferromagnetic metal layer (14) is electrodeposited or deposited electroless.

39. The method for producing a piston rod as claimed in claim 37, wherein upon grinding off the metal (12) filling up the groove structure (11) to obtain a smooth surface (18), an outer metal layer (19) is electrodeposited or deposited electroless.

40. The position measuring system of claim 1 wherein the metal is chromium and each said individual layer has a thickness of less than about 50 μm.

41. A position measuring system for a hydraulic cylinder, comprising a magnet (20), at least one sensor (30, 40), and a piston rod (10) with a metallic core (13) of high magnetic susceptibility and a groove structure (11) in a substantially axial direction, wherein the groove structure (11) is filled up with a metal (12) which has a lower magnetic susceptibility than the core (13), so that the at least one sensor (30, 40) measures a magnetic field of the magnet (20) which is changed in dependence on the position of the groove structure (11), wherein the groove structure (11) is composed of grooves (16) and elevations (15), with individual grooves (16) or elevations (15) omitted, in order to form reference marks (1).

42. The position measuring system for a hydraulic cylinder as claimed in claim 41, wherein the reference marks (1) are arranged such that the number of elevations (15) or grooves (16), which are located between two adjacent reference marks (1), is each different across the entire groove structure (1), so that each interval between two reference marks is denoted unambiguously by the number of elevations (15) or grooves (16).

43. The position measuring system for a hydraulic cylinder as claimed in claim 41, wherein in regions of the piston rod (10), for which a fast indication of position is required, the distances between the reference marks (1) are smaller than in the remaining region.

44. A position measuring system for a hydraulic cylinder, comprising a magnet (20), at least one sensor (30, 40), and a piston rod (10) with a metallic core (13) of high magnetic susceptibility and a groove structure (11) in a substantially axial direction, wherein the groove structure (11) is filled up with a metal (12) which has a lower magnetic susceptibility than the core (13), so that the at least one sensor (30, 40) measures a magnetic field of the magnet (20) which is changed in dependence on the position of the groove structure (11), wherein the metal (12) filling up the groove structure (11) comprises a non-ferromagnetic nickel alloy.

45. The position measuring system for a hydraulic cylinder as claimed in claim 44, wherein the non-ferromagnetic nickel alloy comprises an amount of phosphorus of more than 10.5%.

46. A position measuring system for a hydraulic cylinder, comprising a magnet (20), at least one sensor (30, 40), and a piston rod (10) with a metallic core (13) of high magnetic susceptibility and a groove structure (11) in a substantially axial direction, wherein the groove structure (11) is filled up with a metal (12) which has a lower magnetic susceptibility than the core (13), so that the at least one sensor (30, 40) measures a magnetic field of the magnet (20) which is changed in dependence on the position of the groove structure (11), which furthermore includes a sensor holder (60) which has an aluminum sliding member (50), in which the sensors (30, 40) are located, and a spring (61) for biasing the sliding member onto the piston rod, wherein the sliding member (50) has a coating (51) for reducing friction and for protection against wear, wherein the coating (51) is composed of an electrodeposited nickel layer with PTFE inclusions.

* * * * *

UNITED STATES PATENT AND TRADEMARK OFFICE
Certificate

Patent No. 7,631,592 B2 Patented: December 15, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gerhad Kossmann, Weisweil (DE); Horst Mannebach, Munstermaifeld (DE); Mathias Jirgal, Saarbrucken (DE); and Frank Herold, Saarbrucken (DE).

Signed and Sealed this Twelfth Day of February 2013.

EDWARD LOOK
*Supervisory Patent Examiner*
Art Unit 3745
Technology Center 3700